US010870976B2

(12) United States Patent
Karnegie

(10) Patent No.: US 10,870,976 B2
(45) **Date of Patent: *Dec. 22, 2020**

(54) HAIR STRAINING SYSTEM

(71) Applicant: Juka Innovations Corporation, Farmingdale, NY (US)

(72) Inventor: Serge Karnegie, Farmingdale, NY (US)

(73) Assignee: JUKA INNOVATIONS CORPORATION, Farmingdale, NY (US)

( * ) Notice: Subject to any disclaimer, the term of this patent is extended or adjusted under 35 U.S.C. 154(b) by 154 days.

This patent is subject to a terminal disclaimer.

(21) Appl. No.: 16/361,688

(22) Filed: Mar. 22, 2019

(65) Prior Publication Data

US 2019/0218758 A1 Jul. 18, 2019

Related U.S. Application Data

(63) Continuation-in-part of application No. 29/671,631, filed on Nov. 28, 2018, now Pat. No. Des. 851,225, which is a continuation-in-part of application No. 29/644,282, filed on Apr. 16, 2018, now abandoned, and a continuation-in-part of application No. 29/641,385, filed on Mar. 21, 2018, now Pat. No. Des. 855,782, application No. 16/361,688, which is a continuation-in-part of application No. 15/921,435, filed on Mar. 14, 2018, said application No. 29/671,631 is a continuation-in-part of application No. 15/464,576, filed on Mar. 21, 2017, now Pat. No. 10,570,594, said application No. 15/921,435 is a continuation-in-part of application No. PCT/IB2016/055454, filed on Sep. 13, 2016, which is a continuation-in-part of application No. 14/990,476, filed on Jan. 7, 2016, now Pat. No. 10,344,460, said application No. 29/671,631 is a continuation-in-part of application No. 14/990,476, filed on Jan. 7, 2016, now Pat. No. 10,344,460, application No. 16/361,688, which is a continuation-in-part of (Continued)

(51) Int. Cl.
*E03C 1/264* (2006.01)

(52) U.S. Cl.
CPC ..... *E03C 1/264* (2013.01)

(58) Field of Classification Search
CPC ..... E03C 1/264
USPC ..... 4/291
See application file for complete search history.

(56) References Cited

U.S. PATENT DOCUMENTS 1,595,516 A * 8/1926 Happ ..... E03C 1/262 4/287
1,996,279 A * 4/1935 Dillon ..... E03C 1/264 4/292

(Continued)

OTHER PUBLICATIONS

Uxoz Drain Hair Catcher, Stainless Steel Bathtub Drain Protector, Anti-Rust No Mold (https://www.amazon.com/Uxoz-Catcher-Stainless-Protector-Anti-Rust/dp/B07FFXWG6F/).

(Continued)

*Primary Examiner* — David P Angwin
*Assistant Examiner* — William R Klotz

(57) ABSTRACT

A straining device has an upper wall, a central tube and a lower wall and is positioned in a drain pipe so as to prevent hair from clogging the drain pipe while providing an aesthetically appealing appearance and allowing for easy cleaning.

20 Claims, 18 Drawing Sheets

Related U.S. Application Data application No. 14/990,476, filed on Jan. 7, 2016, now Pat. No. 10,344,460.

(60) Provisional application No. 62/219,223, filed on Sep. 16, 2015.

(56) References Cited

U.S. PATENT DOCUMENTS

| | | | | | |
|---|---|---|---|---|---|
| 2,075,443 | A | * | 3/1937 | Kirschner | E03C 1/262 4/287 |
| 3,075,203 | A | * | 1/1963 | Stafford | E03C 1/244 4/680 |
| 3,982,289 | A | * | 9/1976 | Robbins | E03C 1/264 4/292 |
| D785,767 | S | | 5/2017 | Karnegie | |
| D827,787 | S | | 9/2018 | Karnegie | |
| D827,788 | S | | 9/2018 | Karnegie | |
| D828,523 | S | | 9/2018 | Karnegie | |
| D841,133 | S | | 2/2019 | Karnegie | |

OTHER PUBLICATIONS

Lekeye Drain Hair Catcher/Tub Drain Cover/Bathtub Shower Drain Protector/Strainer (https://www.amazon.com/Lekeye-Catcher-Bathtub-Protector-Strainer-Silver/dp/B07JVNQ6MH/).

* cited by examiner

HAIR STRAINING SYSTEM

CROSS-REFERENCE TO RELATED APPLICATIONS

The present application claims priority to and the benefit of the U.S. Provisional Patent Application Ser. No. 62/219,223 filed on Sep. 16, 2015, and the U.S. Non-Provisional patent application Ser. No. 14/990,476 filed on Jan. 7, 2016, the entire contents of which are hereby incorporated by reference herein.

FIELD OF THE INVENTION

The present application relates to a hair straining system. In particular, the present application relates to a straining device, preferably for use in a shower stall, sink or bathtub to prevent hair from entering and clogging a drain pipe.

BACKGROUND OF THE INVENTION

Drain pipes, particularly those that service shower stalls or bathtubs are often clogged by an accumulation of hair that is shed by users during the bathing process. The hair flows down the drain with the bathing water and accumulates in the drain pipe to form a clog that prevents proper drainage. Existing straining devices to catch this hair are typically provided above the drain pipe opening in the floor of the shower stall or bathtub in view of the user. Such devices are unsightly in that the accumulated hair is visible to the user at all times. These devices also have limited effectiveness and are difficult to clean.

Accordingly, it would be desirable to provide a hair straining system that avoids these and other problems.

SUMMARY OF THE INVENTION

It is an object of the present application to provide a straining device that may be inserted into a drain pipe in a shower stall, sink or bathtub or other similar structure to prevent hair from clogging the drain pipe and to keep the accumulated hair out of view of the user.

It is another object of the present application to provide a hair straining system with the straining device and the drain pipe.

A hair straining system in accordance with an embodiment of the present application comprises a straining device, the straining device comprising a central tube, an upper wall and a lower wall, the central tube comprising a tube body, a top opening, a bottom opening, a plurality of side openings and a hollow core, the top opening and the bottom opening each axially traversing through the tube body, the top opening and the bottom opening being oppositely located to each other, the plurality of side openings laterally traversing through the tube body, the plurality of side openings being located in between the top opening and the bottom opening, the hollow core being surrounded by the tube body, the hollow core being in communication with the top opening, the bottom opening and the plurality of side openings, the upper wall comprising an upper body, the upper body being connected with the tube body, the upper body being adjacently positioned to the top opening, the lower wall comprising a lower body, a lower opening, a plurality of lower holes, a ridge and at least one protrusion, the lower body being connected with the tube body, the lower body being adjacently positioned to the bottom opening, the tube body being located in between the upper body and the lower body, the lower opening axially traversing through the lower body, the lower opening being in communication with the bottom opening, the plurality of lower holes axially traversing through the lower body, the plurality of lower holes being not in communication with the bottom opening, the plurality of lower holes being peripherally distributed around the tube body, the ridge being perimetrically formed on the lower body, the ridge being tapered towards the upper body, a radial diameter of the lower body being larger than a radial diameter of the tube body, the lower body and the ridge each being made of a resilient material, the at least one protrusion being connected with the lower body, the lower body being located in between the tube body and the at least one protrusion, and the at least one protrusion axially extending away from the lower body.

Other features and advantages of the present application will become apparent from the following description of the invention which refers to the accompanying drawings.

DETAILED DESCRIPTION OF THE INVENTION

Figure 13:
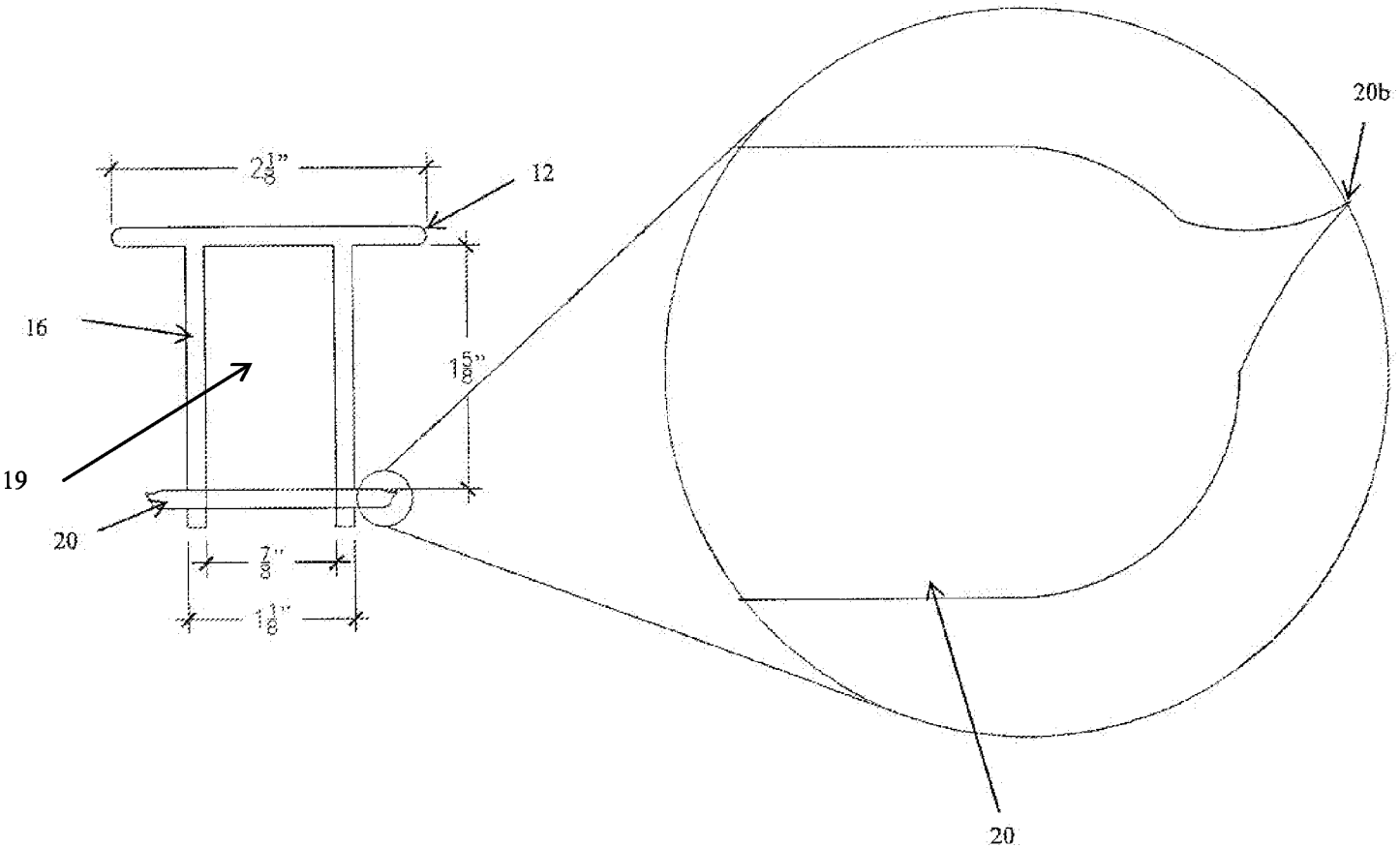
FIG. 13 is a vertical cross-sectional view of a straining device and a detailed view of a ridge of the straining device in accordance with an embodiment of the present application.
Figure 14:
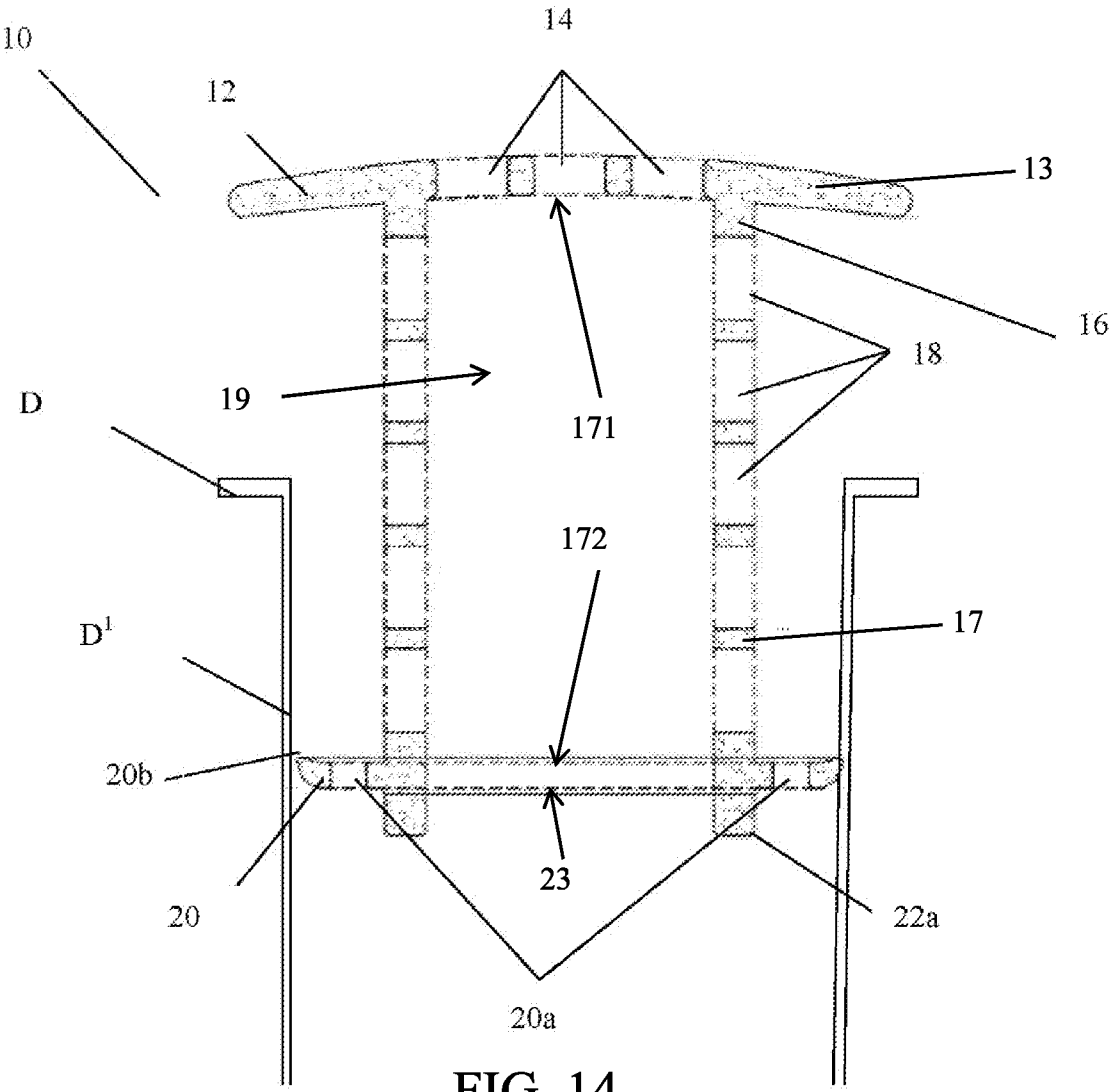
FIG. 14 is a vertical cross-sectional view of a straining device positioned in a drain pipe in accordance with an embodiment of the present application.
Figure 15:
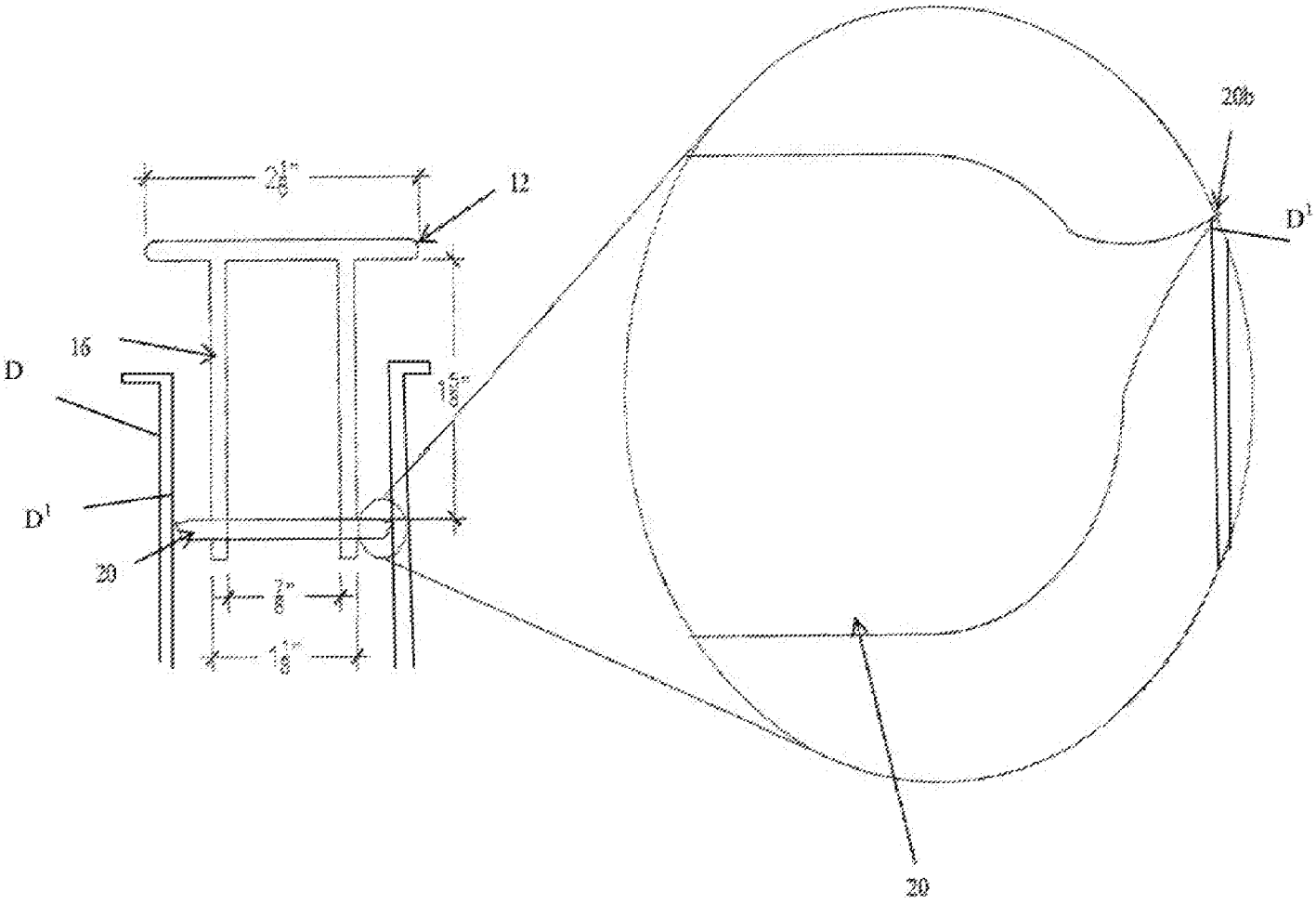
FIG. 15 is a cross-sectional view of a straining device positioned in a drain pipe and a detailed view of a ridge of the straining device in accordance with an embodiment of the present application.

A perspective view of a straining device 10 of a hair straining system is illustrated in FIGS. 1-15. The straining device 10 preferably comprises a central tube 16, an upper wall 12 mounted on a top end of the central tube 16 and a lower wall 20 provided on a bottom end of the central tube 16. The central tube 16 is illustrated as having a cylindrical shape. However, the central tube 16 is not limited to a cylindrical shape. A lower body 22 of the lower wall 20 with at least one protrusion 22*a*, preferably extends from and outward from the bottom end of the central tube 16. The at least one protrusion 22*a* is connected with the lower body 22, the lower body 22 is located in between a tube body 17 of the central tube 16 and the at least one protrusion 22*a*, and the at least one protrusion 22*a* axially extends away from the lower body 22. The central tube 16 comprises a hollow core 19 through which water may pass, whether cylindrical in shape or any other desired shape. In a preferred embodiment, a plurality of side openings 18 are formed in and laterally traverse through the tube body 17 of the central tube 16 to allow water to pass therethrough and into the hollow core 19. The hollow core 19 is surrounded by the tube body 17 and is in communication with the plurality of side openings 18. While the plurality of side openings 18 are preferred, the central tube 16 may need only one single side opening 18. The upper wall 12 preferably comprises a plurality of upper openings 14 that extend through and axially traverse through an upper body 13 of the upper wall 12 to allow water to pass into the hollow core 19 as well. In this embodiment, the central tube 16 comprises a top opening 171 axially traversing through the tube body 17, such that the plurality of upper openings 14 are in communication with the hollow core 19 via the top opening 171. While the plurality of upper openings 14 are shown, a single upper opening 14 may be used. Alternatively, the plurality of upper openings 14 may be eliminated altogether, and thus the upper body 13 could completely seal the top opening 171, as shown in FIGS. 13 and 15. The upper openings 14, the top opening 171 and the side openings 18 allow water to pass into the hollow core 19 of the central tube 16, however, are sized and positioned to impede the passage of hair into the hollow core 19.

The upper wall 12 is preferably substantially disk shaped (see FIGS. 6 and 12, for example) and is mounted on the top end of the central tube 16. The upper wall 12 may be formed integrally with the central tube 16 (see FIG. 7, for example), or may be attached thereto, if desired. The lower wall 20 is preferably substantially ring shaped with a lower opening 23, as shown in FIGS. 7-9 and 14, thereof aligned with the hollow core 19 of the central tube 16. In this embodiment, the central tube 16 comprises a bottom opening 172 axially traversing through the tube body 17, such that the lower opening 23 is in communication with the hollow core 19 via the bottom opening 172. The top opening 171 and the bottom opening 172 are oppositely located to each other, the top opening 171 and the bottom opening 172 are aligned with each other, and the plurality of side openings 18 are located in between the top opening 171 and the bottom opening 172.

The lower wall 20 preferably extends radially outward from the central tube 16 a predetermined distance and comprises a plurality of lower holes 20*a* formed in and axially traversing through the lower body 22 and peripherally distributed around the tube body 17. In an embodiment, the plurality of lower holes 20*a* are not in communication with the bottom opening 172. While it is preferred that the plurality of lower holes 20*a* are provided, fewer or even a single lower hole 20*a* may be used, if desired. The lower holes 20*a* preferably allow the flow of water therethrough, but are sized and positioned to prevent hair from passing therethrough. A radial diameter of the lower body 22 of the lower wall 20 is preferably less or smaller than a radial diameter of the upper body 13 of the upper wall 12 and larger than a radial diameter of the tube body 17 of the central tube 16. FIGS. 13 and 15 illustrate exemplary dimensions of the radial diameters of the lower body 22 of the lower wall 20 and of the upper body 13 of the upper wall 12 and of the tube body 17 of the central cylinder 16.

While the straining device 10 will most commonly be used in s shower stall or s bathtub, it is suitable for use in a drain pipe D such as that used in a sink or another similar structure. FIGS. 14-15 illustrates the straining device 10 positioned in an exemplary embodiment of the drain pipe D. The drain pipe D in a shower stall or a bathtub generally has a standard diameter and the illustrated dimensions discussed above are appropriate for use in such standard drain pipe D such that the radial diameter of the lower body 22 of the lower wall 20 is substantially the same as an inner radial diameter of the drain pipe D and a ridge 20*b* of the lower body 22 of the lower wall 20 contacts against an inner surface D1 of the drain pipe D to form a seal and prevent water from flowing around the ridge 20*b* of the lower body 22 of the lower wall 20. Accordingly, water can only drain into the drain pipe D through the side openings 18 and the hollow core 19 of the central tube 16 or the lower holes 20*a* of the lower wall 20, all of which are sized and spaced to prevent hair from passing therethrough. In an embodiment, the lower opening 23 may be eliminated, and thus the lower body 22 could completely seal the bottom opening 172, as shown in FIGS. 13 and 15. In the event that a water level exceeds a height of the upper body 13 of the upper wall 12, the upper openings 14 are also sized and positioned to prevent the passage of hair therethrough, while allowing water to pass. In an embodiment, the side opening 18 may be 7/32 inch wide, the upper opening 14 may be 1/8 inch wide and the lower hole 20*a* may be 1/8 inch wide. While these dimensions are preferred, they may vary provided that the upper openings 14, the side openings 18 and the lower holes 20*a* prevent hair from passing therethrough.

The drain pipe D in a sink tend to be somewhat narrower than those in a shower stall or a bathtub and the straining device 10 may be dimensioned for use in a sink as well. That is, the dimensions of the straining device 10 may be modified as desired to be used with and inserted into another different drain pipe.

Figure 7:
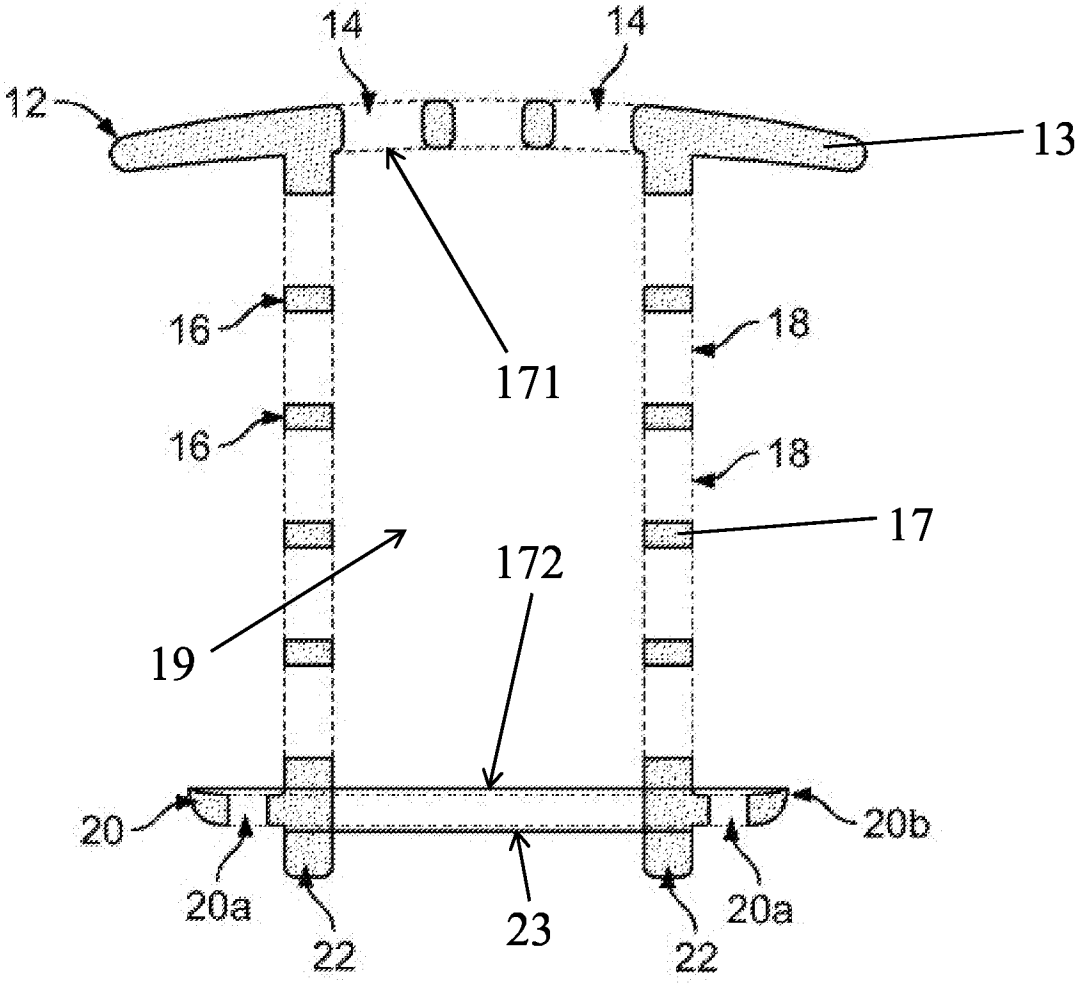
FIG. 7 is a vertical cross-sectional view of a straining device in accordance with an embodiment of the present application.
Figure 8:
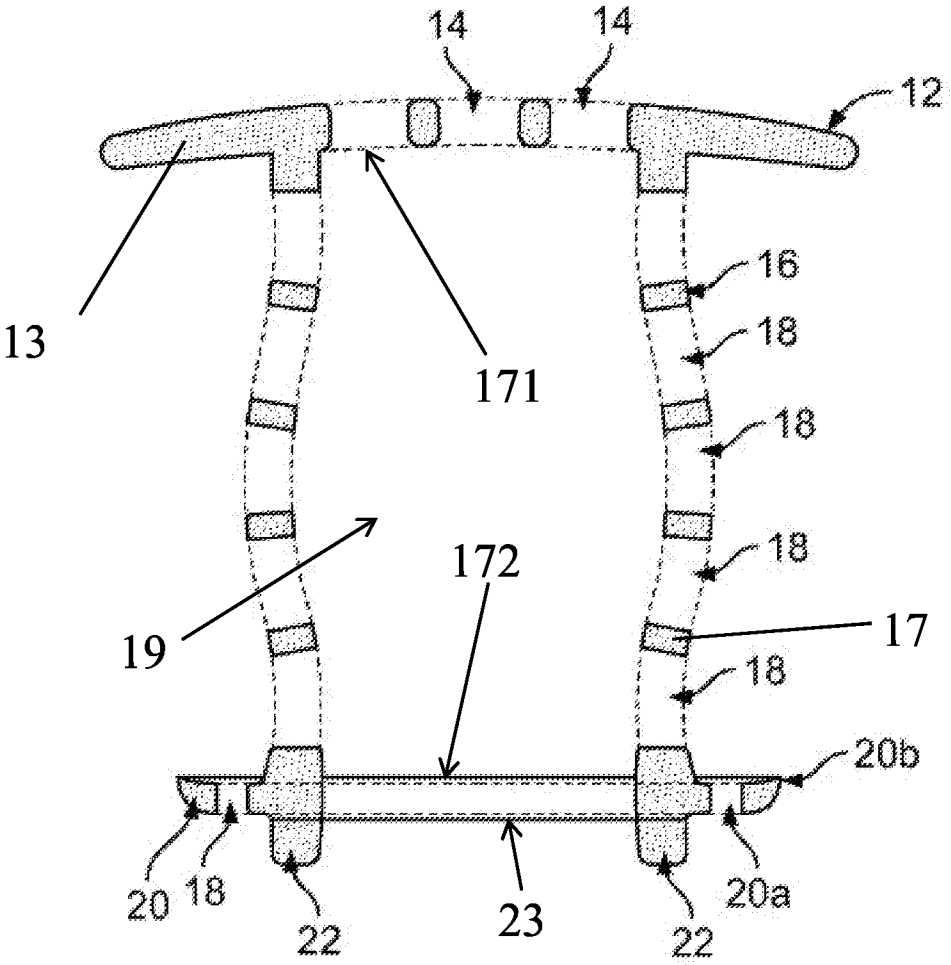
FIG. 8 is a vertical cross-sectional view of a straining device of FIG. 1 in which the central tube comprises a curved tube body.
Figure 9:
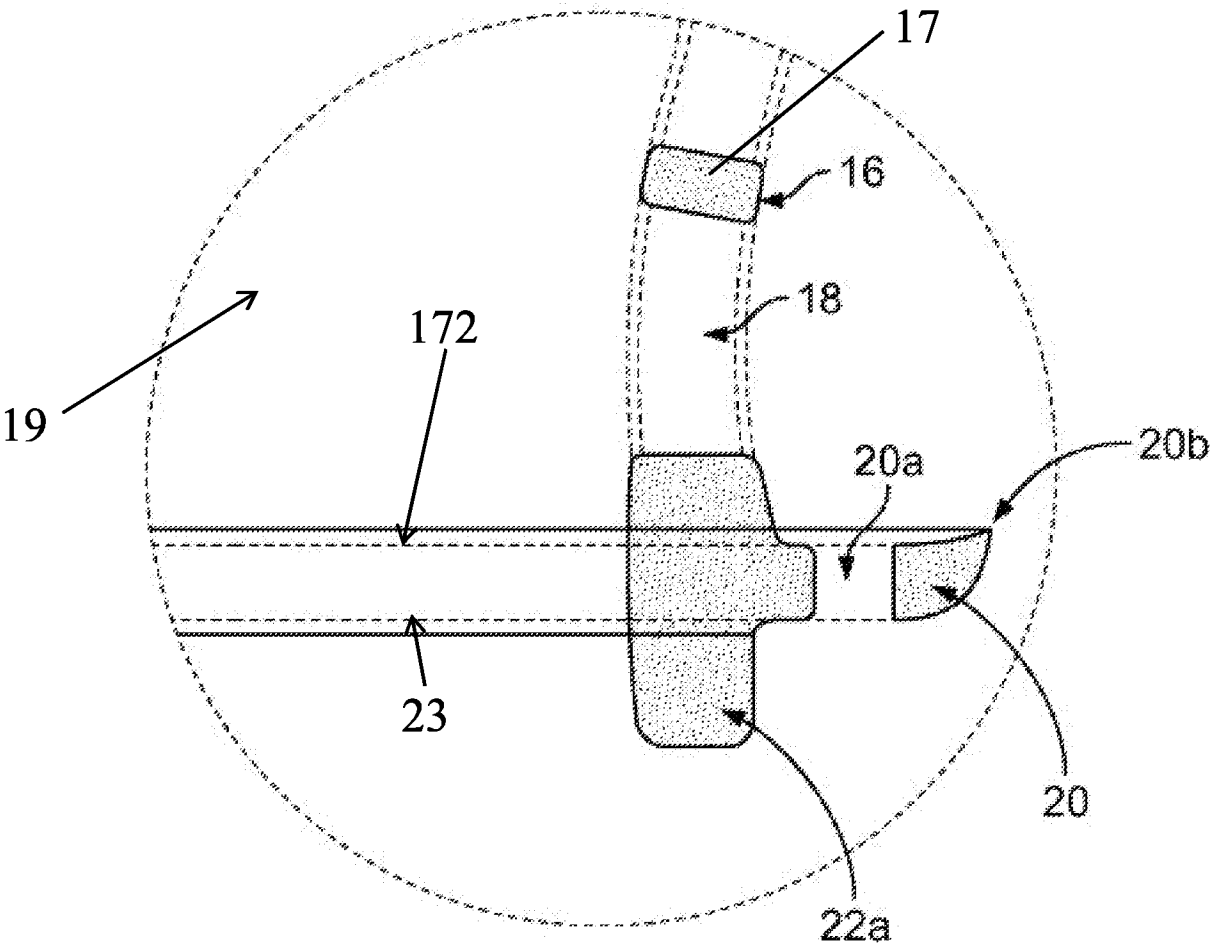
FIG. 9 is a detailed view of a ridge of a straining device in accordance with an embodiment of the present application.
Figure 10:
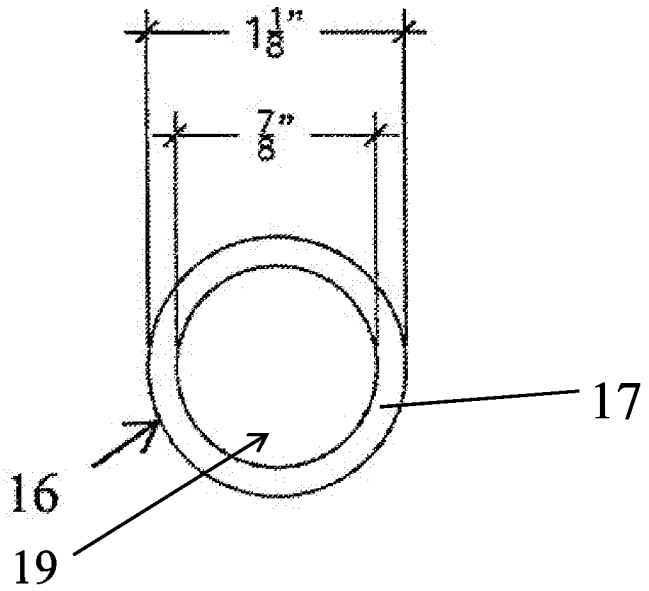
FIG. 10 is a horizontal cross-sectional view of a central tube of a straining device in accordance with an embodiment of the present application illustrating an exemplary thickness of a tube body.
Figure 11:
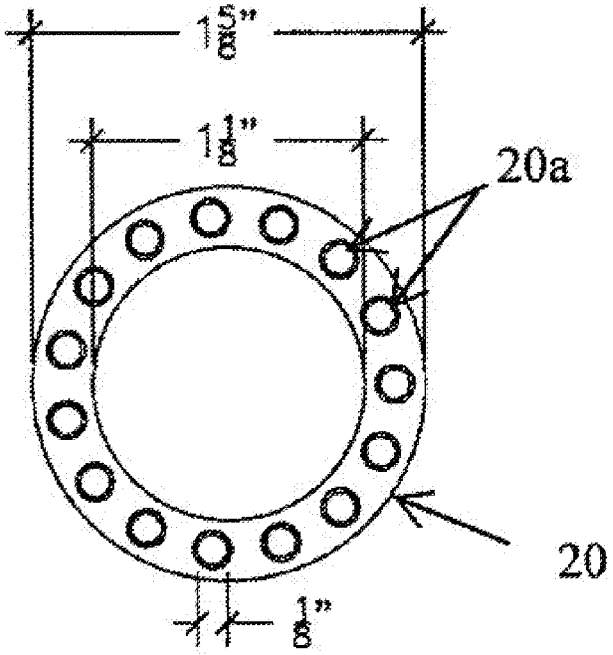
FIG. 11 is detailed view of a lower wall of a straining device in accordance with an embodiment of the present application indicating exemplary dimensions thereof.
Figure 12:
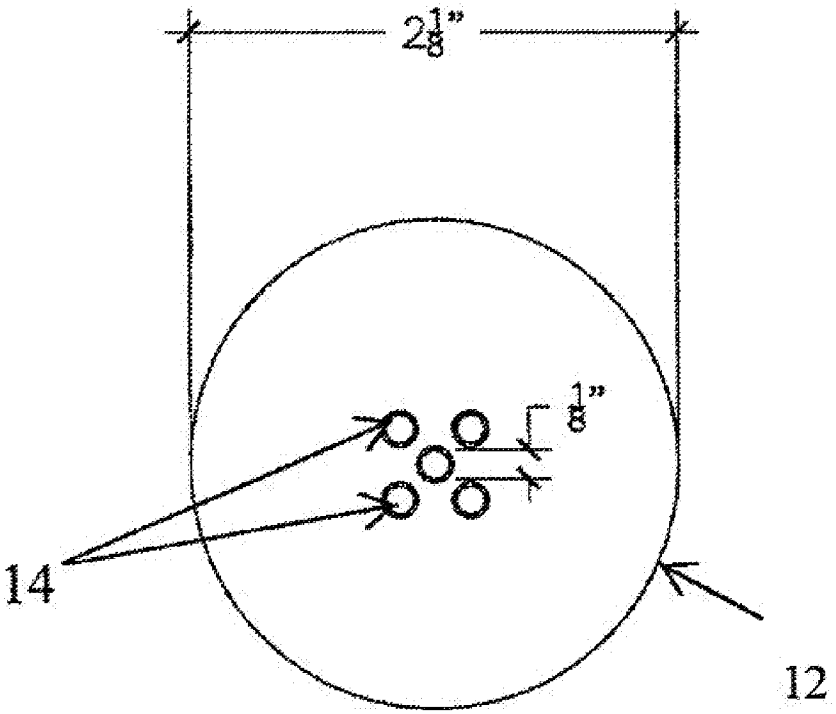
FIG. 12 is a detailed view of an upper wall of a straining device in accordance with an embodiment of the present application indicating exemplary dimensions thereof.

As can be seen in FIG. 7, the central tube 16 may have substantially a straight tube body 17. Alternatively, the central tube 16 may include a curved tube body 17, or the tube body 17 is preferably made of a resilient material, as illustrated in FIG. 8. The lower wall 20 preferably comprises the ridge 20*b* perimetrically formed on an outer edge of the lower body 22 and tapered towards the upper body 13. This ridge 20*b* preferably provides the seal between the inner surface D1 of the drain pipe D and the lower wall 20 when the straining device 10 is inserted into the drain pipe D, as illustrated in FIGS. 14-15, for example. The ridge 20*b* prevents the flow of water around the lower wall 20 of the straining device 10. This ridge 20*b* is visible in more detail in FIGS. 9, 13 and 15, for example.

In use, the straining device 10 is inserted into the drain pipe D. The lower wall 20 is sized to be received in the drain pipe D with the ridge 20*b* in contact with the inner surface D1 to form a seal to prevent water from flowing around the lower wall 20. This forces water to pass through the lower holes 20*a* in the lower wall 20, or the side openings 18 in the tube body 17 of the central tube 16 and then the bottom opening 172 in the tube body 17 of the central tube 16 and the lower opening 23 in the lower body 22 of the lower wall 20. The size and spacing of these side openings 18 and the lower holes 20*a* prevent hair in the water from passing therethrough, particularly long hair. The ridge 20*b* is preferably made of a somewhat resilient material to allow some flexing, as can be seen in FIG. 15, for example, on insertion into the drain pipe D to provide a tight seal. The upper body 13 of the upper wall 12 preferably has the radial diameter that is larger than the inner radial diameter of an open end of the drain pipe D and the radial diameter of the lower body of the lower wall 20, as can be seen in FIGS. 13-15, for example.

In a preferred embodiment, the straining device 10 is inserted into the drain pipe D such that the upper wall 12 and an upper portion of the tube body 17 of the central tube 16 are visible above the drain pipe D, but the lower wall 20 and a lower portion of the tube body 17 of the central tube 16 are inside the drain pipe D and not visible. This positioning is illustrated in FIGS. 14-15, for example. As water flows to the drain pipe D, it flows through the side openings 18 and the lower holes 20*a* in the central cylinder 16, respectively, and into the drain pipe D. As noted above, the size of and spacing between the side openings 18, and the lower holes 20*a* prevent hair in the water from passing therethrough such that the hair accumulates on the lower wall 20 and around the central tube 16, out of sight of a user. The shape of the central tube 16 and the ring shape of the lower wall 20 encourage the hair to wrap around the central tube 16 such that it can easily be removed when necessary. The straining device 10 is preferably made of a somewhat resilient material such as silicon or other rubber like material, however, is not limited to any specific material. In this embodiment, the tube body 17, the upper body 13, the lower body 22, the ridge 20*b* and the at least one protrusion 22*a* each may be made of a resilient material. Alternatively, the straining device 10 may be made of a non-resilient material, such as a metal material. In this embodiment, the tube body 17, the upper body 13, the lower body 22, the ridge 20*b* and the at least one protrusion 22*a* each may be made of a non-resilient material. In another embodiment, at least one of the tube body 17, the upper body 13, the lower body 22, the ridge 20*b* and the at least one protrusion 22*a* is made of a resilient material while at least one of the tube body 17, the upper body 13, the lower body 22, the ridge 20*b* and the at least one protrusion 22*a* is made of a non-resilient material. The material of the straining device 10 may be colored to provide for a pleasing appearance, as desired. The straining device 10 may be inserted deeper into the drain pipe D than illustrated in FIGS. 14-15, if desired, and may be inserted deep enough that the upper wall 12 covers the open end of the drain pipe D entirely. Further, the straining device 10 may be inserted less deep into the drain pipe D provided that at least the lower wall 20 is positioned inside the drain pipe D and out of view.

The straining device 10 of the present application provides for excellent straining performance while ensuring that unsightly accumulations of hair remain out of sight of the user. In addition, since hair tends to wrap around the central tube 16 as it accumulates, removal of this hair from the straining device 10 is relatively quick and easy after the straining device 10 is removed from the drain pipe D. Thus, the straining device 10 of the hair straining system of the present application provides excellent straining functionality while providing an overall aesthetically pleasing appearance and easy cleaning.

Figure 16:
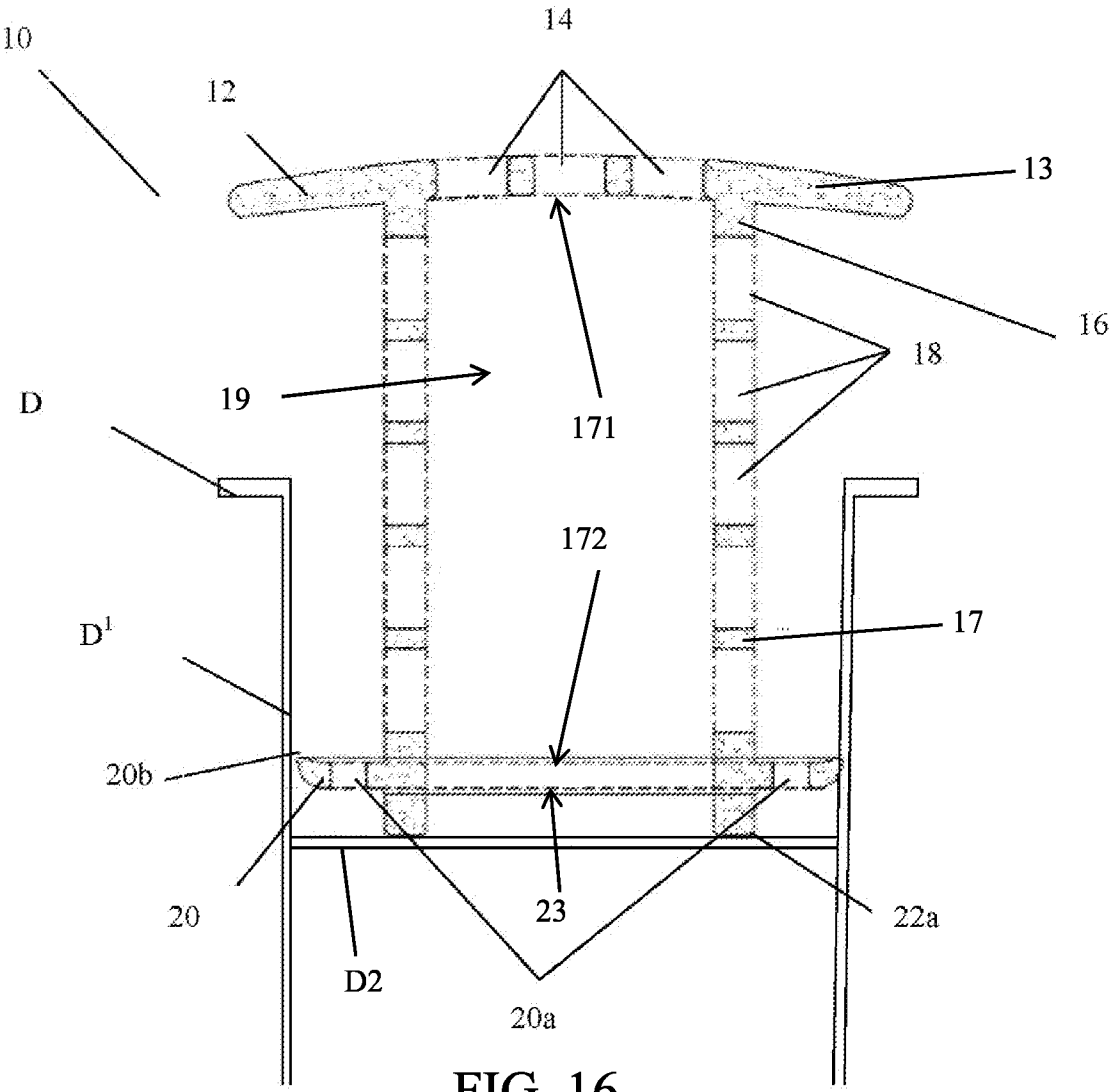
FIG. 16 is a vertical cross-sectional view of a straining device positioned in a drain pipe with a crossbar in accordance with an embodiment of the present application.

The purpose of the at least one protrusion 22*a* is to improve water flow because the drain pipe D has a crossbar D2 where the straining device 10 sits on, as shown in FIG. 16. The straining device 10 would still work without the at least one protrusion 22*a*, just not as well because there are the plurality of lower holes 20*a* on the lower body 22 that get blocked by the crossbar D2 that the straining device 10 is sitting on. The at least one protrusion 22*a* ensures the lower body 22 is not touching the crossbar D2 by generating a space in between the lower body 22 and the crossbar D2 so as to minimize blockage of water and air.

Figure 1:
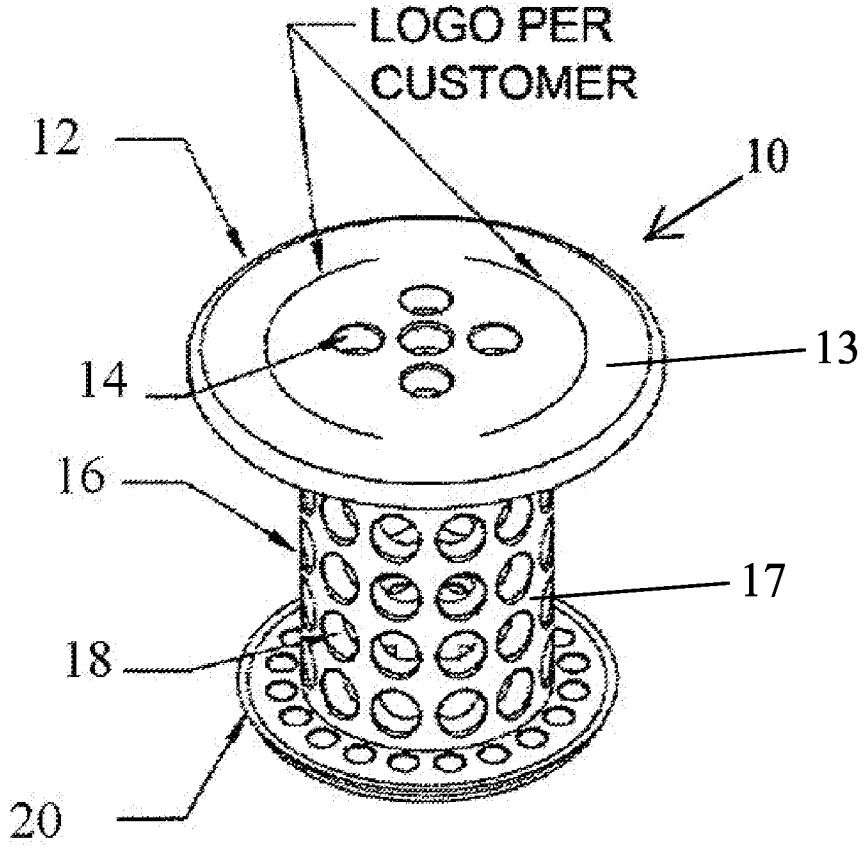
FIG. 1 illustrates a front and top perspective view of a straining device in accordance with an embodiment of the present application.
Figure 2:
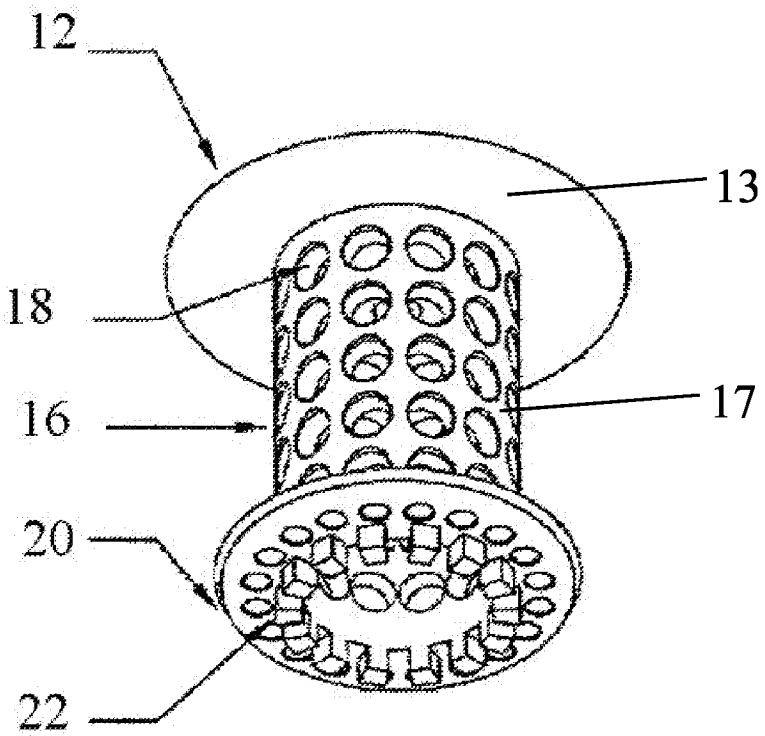
FIG. 2 illustrates a front and bottom perspective view of a straining device in accordance with an embodiment of the present application.
Figure 3:
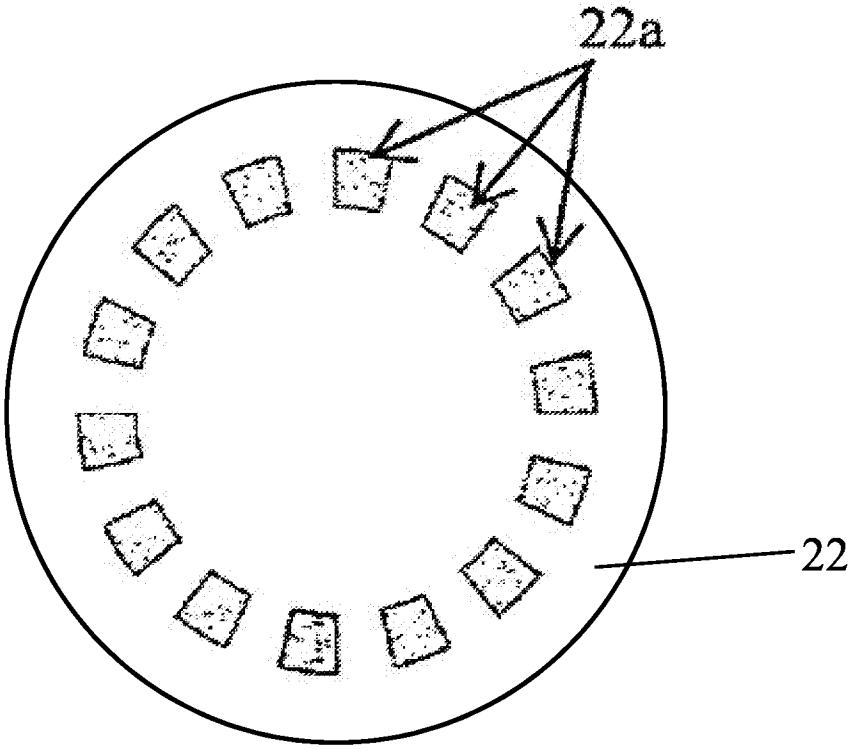
FIG. 3 is a detailed view of an arrangement of a plurality of protrusions of a straining device in accordance with an embodiment of the present application.
Figure 4:
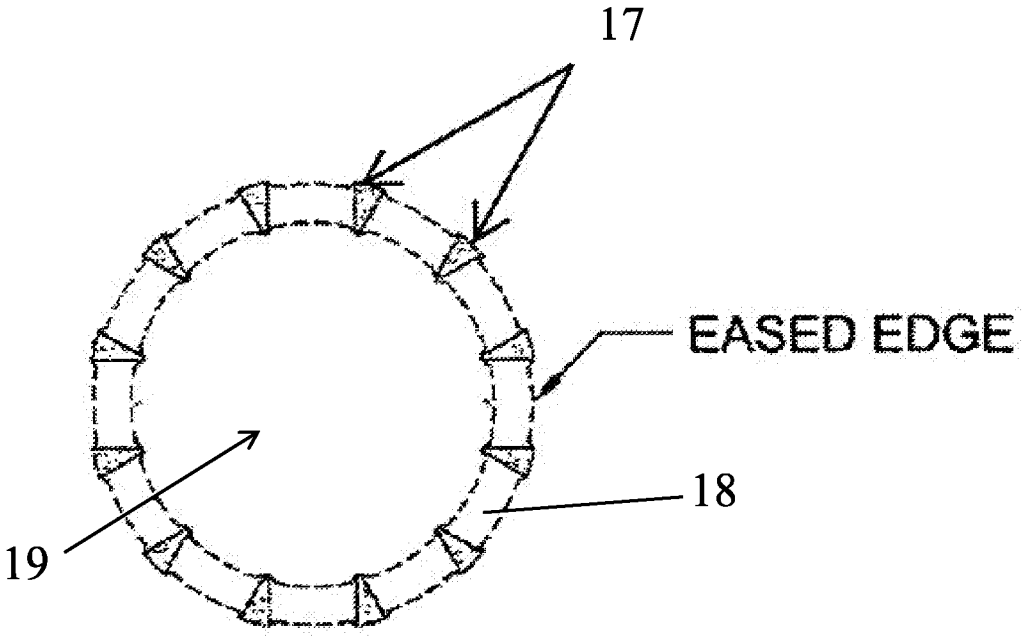
FIG. 4 is a horizontal cross-sectional view of a central tube of a straining device in accordance with an embodiment of the present application.
Figure 5:
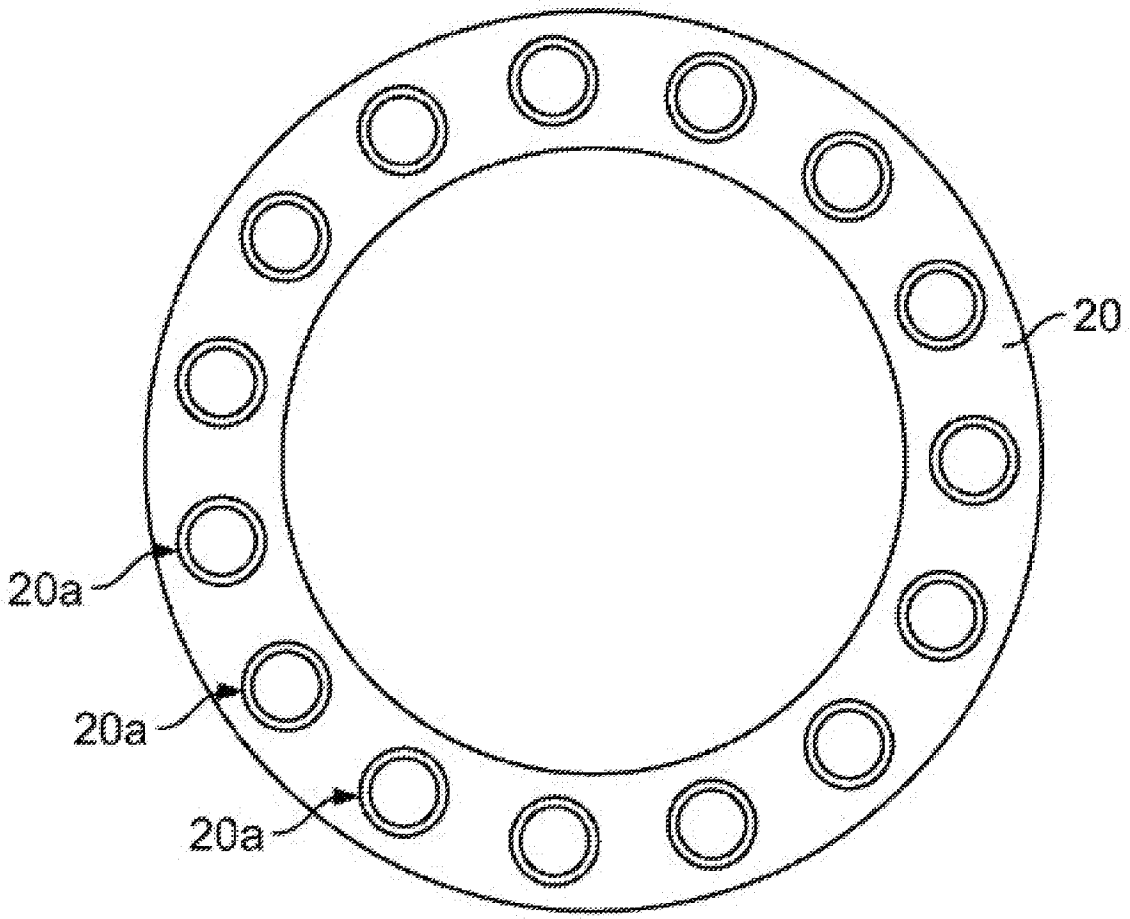
FIG. 5 is a detailed view of a lower wall of a straining device of in accordance with an embodiment of the present application.
Figure 6:
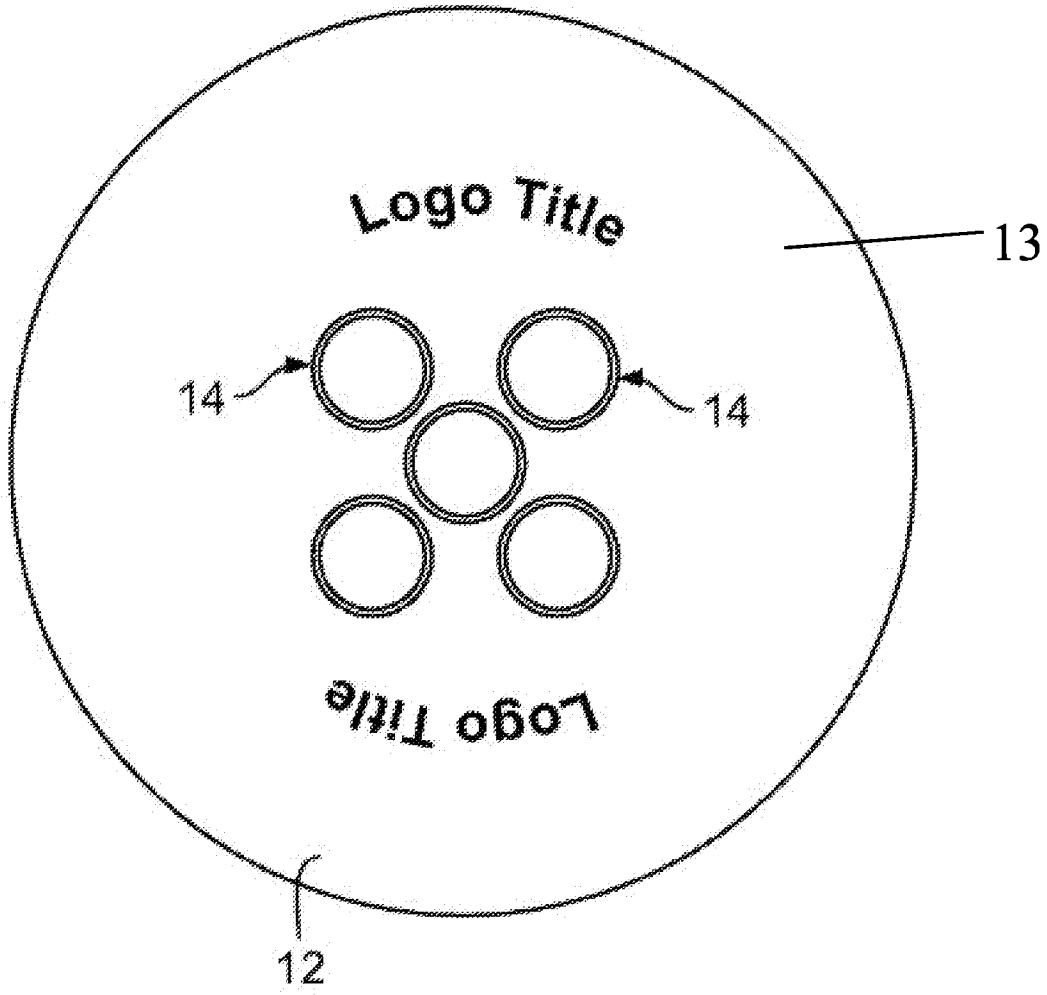
FIG. 6 is a detailed view of an upper wall of a straining device in accordance with an embodiment of the present application.

In an embodiment, the at least one protrusion 22*a* are a plurality of protrusions 22*a*, as shown in FIGS. 2-3 and 16. In an aspect, the plurality of protrusions 22*a* are distributed on the lower body 22, as shown in FIG. 3. In an aspect, the plurality of protrusions 22*a* are peripherally distributed around the lower opening 23, and a corresponding protrusion 22*a* among the plurality of protrusions 22*a* is located in between the lower opening 23 and a corresponding lower hole 20*a* among the plurality of lower holes 20*a*, as shown in FIG. 2. The plurality of protrusions 22*a* further have even fewer touch points with the crossbar D2.

Figure 19:
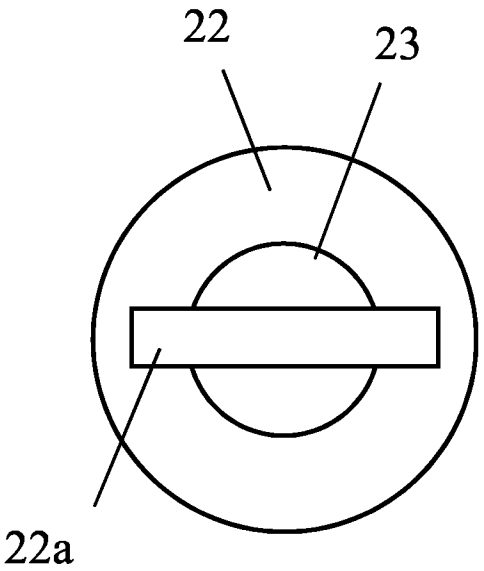
FIG. 19 is a detailed view of an arrangement of a single protrusion located across a lower opening in accordance with an embodiment of the present application.
Figure 18:
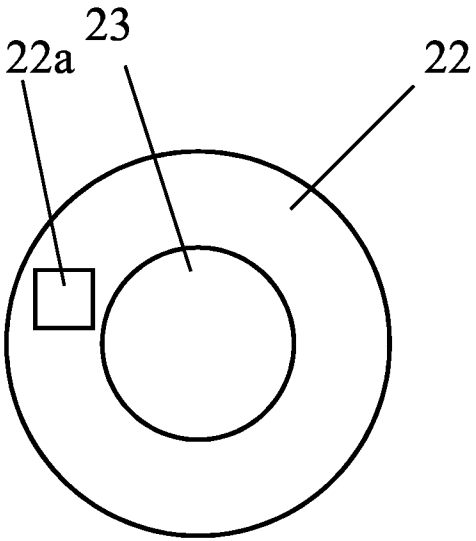
FIG. 18 is a detailed view of an arrangement of a single protrusion peripherally distributed around a lower opening in accordance with an embodiment of the present application.
Figure 17:
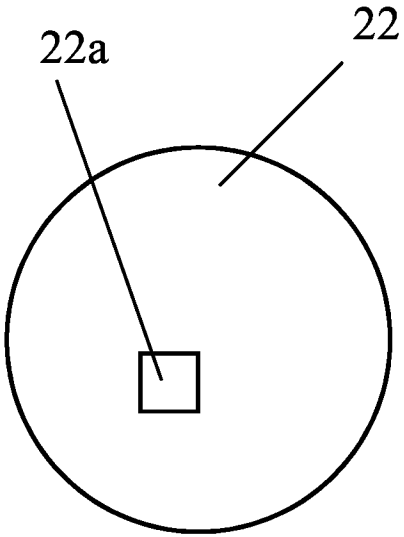
FIG. 17 is a detailed view of an arrangement of a single protrusion distributed on a lower body in accordance with an embodiment of the present application.
Figure 21:
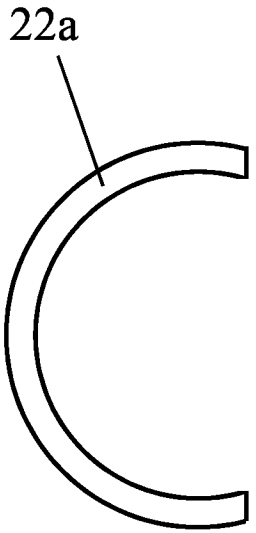
FIG. 21 is a detailed view of a single protrusion of C-shaped in accordance with an embodiment of the present application.
Figure 20:
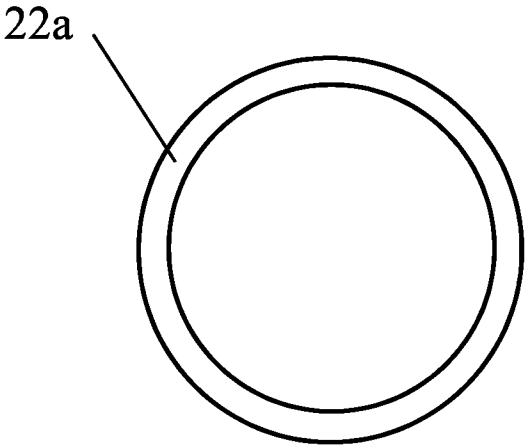
FIG. 20 is a detailed view of a single protrusion of ring-shaped in accordance with an embodiment of the present application.

In an embodiment, the at least one protrusion 22*a* is a single protrusion 22*a*, as shown in FIGS. 17-21. In an aspect, the single protrusion 22*a* is distributed on the lower body 22, as shown in FIG. 17. In an aspect, the single protrusion 22*a* is peripherally distributed around the lower opening 23, as shown in FIG. 18. In an aspect, the single protrusion is located across the lower opening 23, as shown in FIG. 19. In an aspect, the single protrusion is of ring-shaped, as shown in FIG. 20. In an aspect, the single protrusion is of C-shaped, as shown in FIG. 21. In an aspect, the single protrusion is of rectangle-shaped, as shown in FIGS. 17-19. The benefit of the plurality of protrusions 22*a* over single protrusion 22*a* is not all that noticeable in testing. Minimal at best.

In an embodiment, the hair straining system comprises both of the straining device 10 and the drain pipe D.

Although the present application has been described in relation to particular embodiments thereof, many other variations and modifications and other uses will become apparent to those skilled in the art.

What is claimed is:

1. A hair straining system comprising:
a straining device;
the straining device comprising a central tube, an upper wall and a lower wall;
the central tube comprising a tube body, a top opening, a bottom opening, a plurality of side openings and a hollow core;
the top opening and the bottom opening each axially traversing through the tube body;
the top opening and the bottom opening being oppositely located to each other;
the plurality of side openings laterally traversing through the tube body;
the plurality of side openings being located in between the top opening and the bottom opening;
the hollow core being surrounded by the tube body;
the hollow core being in communication with the top opening, the bottom opening and the plurality of side openings;
the upper wall comprising an upper body;
the upper body being connected with the tube body;
the upper body being adjacently positioned to the top opening;
the lower wall comprising a lower body, a lower opening, a plurality of lower holes, a ridge and at least one protrusion;
the lower body being connected with the tube body;
the lower body being adjacently positioned to the bottom opening;
the tube body being located in between the upper body and the lower body;
the lower opening axially traversing through the lower body;
the lower opening being in communication with the bottom opening;
the plurality of lower holes axially traversing through the lower body;
the plurality of lower holes being not in communication with the bottom opening;
the plurality of lower holes being peripherally distributed around the tube body;
the ridge being perimetrically formed on the lower body;
the ridge being tapered towards the upper body;
a radial diameter of the lower body being larger than a radial diameter of the tube body;
the lower body and the ridge each being made of a resilient material;
the at least one protrusion being connected with the lower body;
the lower body being located in between the tube body and the at least one protrusion; and
the at least one protrusion axially extending away from the lower body.

2. The hair straining system of claim 1 comprising:
the top opening and the bottom opening being aligned with each other.

3. The hair straining system of claim 1 comprising:
the radial diameter of the lower body being smaller than a radial diameter of the upper body.

4. The hair straining system of claim 1 comprising:
the upper wall comprising a plurality of upper openings; and
the plurality of upper openings axially traversing through the upper body.

5. The hair straining system of claim 4 comprising:
the plurality of upper openings being in communication with the top opening.

6. The hair straining system of claim 1 comprising:
the tube body being made of a resilient material.

7. The hair straining system of claim 1 comprising:
the upper body being made of a resilient material.

8. The hair straining system of claim 1 comprising:
the at least one protrusion being made of a resilient material.

9. The hair straining system of claim 1 comprising:
the at least one protrusion being a plurality of protrusions.

10. The hair straining system of claim 9 comprising:
the plurality of protrusions being peripherally distributed around the lower opening.

11. The hair straining system of claim 9 comprising:
a corresponding protrusion among the plurality of protrusions being located in between the lower opening and a corresponding lower hole among the plurality of lower holes.

12. The hair straining system of claim 1 comprising:
the at least one protrusion being a single protrusion.

13. The hair straining system of claim 12 comprising:
the single protrusion being peripherally distributed around the lower opening.

14. The hair straining system of claim 12 comprising:
the single protrusion being located across the lower opening.

15. The hair straining system of claim 12 comprising:
the single protrusion being of ring-shaped.

16. The hair straining system of claim 12 comprising:
the single protrusion being of C-shaped.

17. The hair straining system of claim 12 comprising:
the single protrusion being of rectangle-shaped.

18. The hair straining system of claim 1 comprising:
a drain pipe; and
the straining device being configured to be inserted the drain pipe.

19. The hair straining system of claim 18 comprising:
the radial diameter of the lower body being substantially the same as an inner radial diameter of the drain pipe; and
a radial diameter of the upper body being larger than the inner radial diameter of the drain pipe.

20. The hair straining system of claim 18 comprising:
the drain pipe comprising a crossbar; and
the at least one protrusion being configured to contact against the crossbar.

* * * * *